US010710826B2

(12) United States Patent
Nameroff et al.

(10) Patent No.: US 10,710,826 B2
(45) Date of Patent: Jul. 14, 2020

(54) SHEET TRANSPORT WITH ONE-WAY CLUTCH TO DISENGAGE SEPARATION SHAFT

(71) Applicant: HEWLETT-PACKARD DEVELOPMENT COMPANY, L.P., Houston, TX (US)

(72) Inventors: Alexander M. Nameroff, Portland, OR (US); Devin Scott Uehling, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/044,925

(22) Filed: Jul. 25, 2018

(65) Prior Publication Data

US 2018/0327203 A1 Nov. 15, 2018

Related U.S. Application Data

(62) Division of application No. 15/407,959, filed on Jan. 17, 2017, now Pat. No. 10,081,507.

(51) Int. Cl.

| | |
|---|---|
| ***B65H 3/52*** | (2006.01) |
| ***B65H 83/02*** | (2006.01) |
| ***B65H 3/06*** | (2006.01) |

(52) U.S. Cl.

CPC ..... *B65H 3/52* (2013.01); *B65H 3/0669* (2013.01); *B65H 3/5207* (2013.01); *B65H 3/5215* (2013.01); *B65H 3/5246* (2013.01); *B65H 3/5253* (2013.01); *B65H 3/5261* (2013.01); *B65H 83/025* (2013.01); *B65H 2403/72* (2013.01); *B65H 2403/942* (2013.01)

(58) Field of Classification Search

CPC .. B65H 3/0623; B65H 3/0669; B65H 3/0676; B65H 3/52; B65H 3/5207; B65H 3/5215; B65H 3/5246; B65H 3/5253; B65H 3/5261; B65H 83/025; B65H 2301/4234; B65H 2403/72; B65H 2403/942

USPC ..... 271/122, 125, 116, 114

See application file for complete search history.

(56) References Cited

U.S. PATENT DOCUMENTS

| | | | |
|---|---|---|---|
| 2,813,717 | A | 11/1957 | Mentzer |
| 4,638,987 | A | 1/1987 | Sakurai |

(Continued)

OTHER PUBLICATIONS

Related U.S. Appl. No. 15/294,385, filed Oct. 14, 2016.

*Primary Examiner* — David H Bollinger
(74) *Attorney, Agent, or Firm* — Faban VanCott

(57) ABSTRACT

In one example in accordance with the present disclosure, a sheet transport device is described. The sheet transport device includes a pickup roller to insert a sheet into a sheet path. A pair of separation rollers of the sheet transportation device form a nip that advances the sheet along the sheet path. A first separation shaft on which a first separation roller is disposed rotates in a first direction as the sheet is advanced and a second separation shaft on which a second separation roller is disposed also rotates in the first direction as the sheet is advanced. The second separation roller is driven in a second direction via a torque limiter. A motor rotates the shafts. A one-way clutch is disposed on the second separation shaft to disengage the second separation shaft from the motor when the motor is operating in a reverse mode.

14 Claims, 4 Drawing Sheets

(56) References Cited

U.S. PATENT DOCUMENTS

| | | | | |
|---|---|---|---|---|
| 5,085,420 | A * | 2/1992 | Sata | B65H 3/0669 271/114 |
| 5,571,265 | A | 11/1996 | Yagi | |
| 5,755,435 | A | 5/1998 | Fujiwara | |
| 5,882,002 | A * | 3/1999 | Kamei | B65H 3/5261 271/118 |
| 5,901,951 | A | 5/1999 | Yamaguchi | |
| 6,412,771 | B1 | 7/2002 | Hirata et al. | |
| 6,601,843 | B2 * | 8/2003 | Miki | B65H 3/0669 271/10.13 |
| 7,354,038 | B2 * | 4/2008 | Watase | B65H 3/0615 271/10.12 |
| 7,677,550 | B2 | 3/2010 | Okazaki | |
| 8,678,372 | B2 * | 3/2014 | Yasukawa | B65H 7/12 271/10.09 |
| 8,979,088 | B2 * | 3/2015 | Itabashi | B65H 5/068 271/10.04 |
| 9,757,965 | B1 | 9/2017 | Uehling | |
| 2005/0138433 | A1 | 6/2005 | Linetsky | |
| 2006/0145410 | A1 | 7/2006 | Park | |
| 2006/0180990 | A1 | 8/2006 | Ueda | |
| 2010/0244363 | A1 | 9/2010 | Sheng | |
| 2013/0221602 | A1 | 8/2013 | Walsh et al. | |

* cited by examiner

SHEET TRANSPORT WITH ONE-WAY CLUTCH TO DISENGAGE SEPARATION SHAFT

BACKGROUND

In modern day printing devices, and other media processing systems, sheets of media such as paper initially reside in an input tray. A portion of a sheet feed system within the media processing systems moves a single sheet from a media stack in the input tray through the printing device. Along the sheet path, the sheet of media passes by a fluid ejection device that deposits a fluid such as ink onto the sheet to form text and/or images on the media. In another example, the sheet of media passes by a toner deposition device that deposits toner onto the sheet of media to form the text and/or images on the media.

BRIEF DESCRIPTION OF THE DRAWINGS

The accompanying drawings illustrate various examples of the principles described herein and are part of the specification. The illustrated examples are given merely for illustration, and do not limit the scope of the claims.

Throughout the drawings, identical reference numbers designate similar, but not necessarily identical, elements.

DETAILED DESCRIPTION

Figure 1:
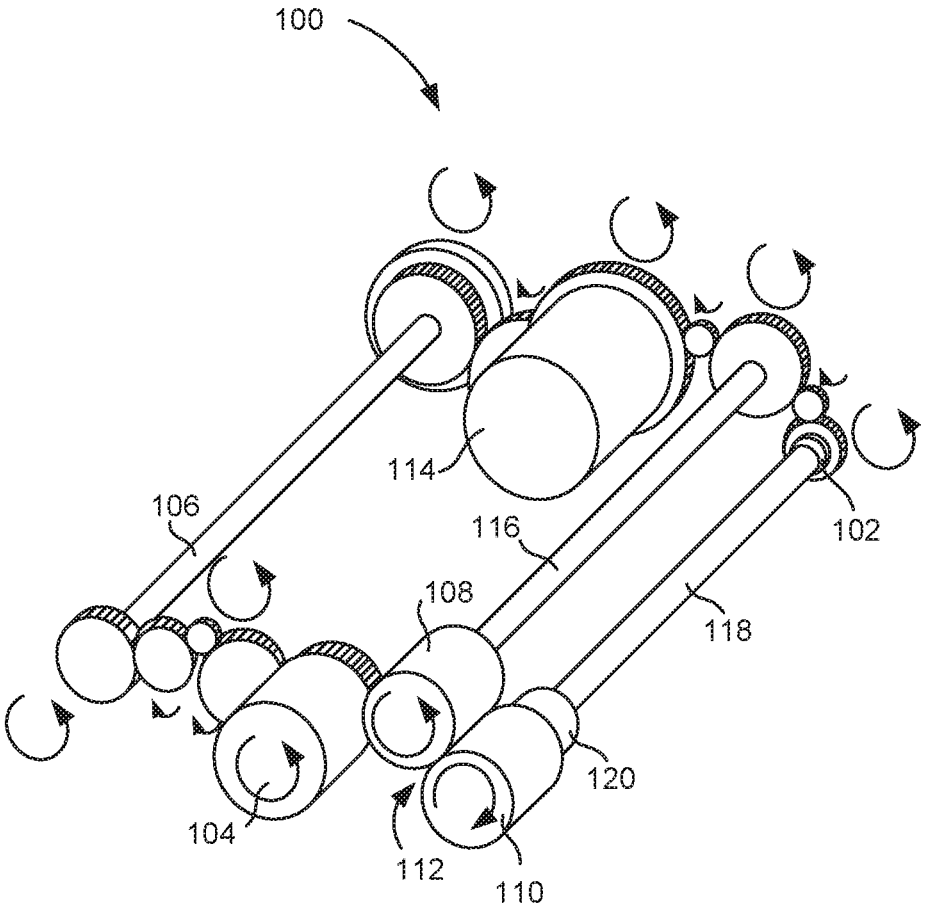
FIG. 1 is an isometric view of a sheet transport device with a one-way clutch, according to an example of the principles described herein.

In modern day printing devices, and other media processing systems, sheets of media such as paper initially reside in an input tray. A portion of a sheet feed system within the media processing systems moves a single sheet from a media stack in the input tray through the printing device. Along the sheet path, the sheet of media passes by a fluid ejection device that deposits a fluid such as ink onto the sheet to form text and/or images on the media. In another example, the sheet of media passes by a toner deposition device that deposits toner onto the sheet of media to form the text and/or images on the media. The sheet-feeding device as described herein can be found in any number of media processing systems such as copiers, printers, facsimile machines, scanners, or combinations thereof, among other devices that move sheets of media as part of their operation.

While such media transport systems have undoubtedly increased the ability to process media within a system, certain complications can adversely affect their operation. For example, it may be desirable that a single sheet of media at a time be fed through the media processing system to ensure proper processing of the job. In a printing device, feeding multiple sheets of media from the same input tray at the same time, could lead to improper deposition of the ink or toner on the multiple sheets. Still further, due to the tight tolerances within such media processing systems, a second sheet of media being fed out of an input tray could result in a clog or other jam within the media processing system. Accordingly, it may be desirable to ensure the sequential insertion of media into the sheet path from a particular input tray. Moreover, when printing, or any other media processing operation, comes to completion, the media may be partially disposed in the input tray and partially disposed along the media transport path. This partial deposition of the media in the input tray could lead to jams in subsequent operations and could lead to damage of the media as a user opens the input tray to access the media.

Accordingly, the present specification describes an operation wherein the insertion of multiple sheets of media at one time from a particular input tray is prevented. The device and method also ensure that after printing, media is fully disposed within the input tray and not partially disposed in the input tray.

Specifically, during forward advance of media, i.e., during printing, a motor rotates in a first direction and a pair of separation rollers advance the media through the sheet path. Upon completion of a print job, or at another predetermined time, the motor is reversed such that media that is in the process of being inserted between the separation rollers, is moved back into the input tray.

Specifically, the present specification describes a sheet transport device. The sheet transport device includes a pickup roller to insert a sheet of media into a sheet path, and a pair of separation rollers, forming a nip, to advance the sheet along the sheet path. A first separation shaft, on which a first separation roller is disposed, rotates in a first direction as the sheet is advanced along the sheet path and a second separation shaft, on which a second separation roller is disposed, rotates in the first direction as the sheet is advanced along the sheet path. However, the second separation roller is driven in a second direction, opposite the first direction, via a torque limiter. A motor of the sheet transport device rotates the first separation shaft and the second separation shaft, as well as a pickup shaft on which the pickup roller is disposed. A one-way clutch disposed on the second separation shaft disengages the second separation shaft from the motor when the motor is operating in a reverse mode.

The present specification also describes a sheet transport system. The sheet transport system includes a sheet transport device. The sheet transport device includes a pickup roller to insert a sheet of media from a sheet tray into a sheet path and a pair of separation rollers forming a nip to advance the sheet along the sheet path. The sheet transport device also includes a torque limiter disposed on a second separation shaft and a one-way clutch disposed on the second separation shaft. The sheet transport device also includes a motor. In addition to the sheet transport device, the sheet transport system also has a transport path shaft that advances a sheet of media not originating from the sheet tray along the sheet path. In operation, the motor: 1) rotates in a forward direction to drive the pickup roller, a first separation roller and a second separation roller, and 2) rotates in a reverse direction to drive the first separation roller and a transport path roller.

The present specification also describes a method for transporting a sheet. According to the method, a motor is driven in a forward mode to rotate a pickup roller, a first separation shaft in a first direction, and a second separation shaft in the first direction while a transport path shaft is disengaged. A second separation roller that is disposed on the second separation shaft is driven in a second direction via a torque limiter. The motor is then driven in the reverse mode to rotate the first separation shaft in a second direction and to activate the transport path shaft while the pickup roller and second separation shaft are disengaged from the motor.

In one example, using such a sheet transport device and method: 1) allows for prevention of the insertion of multiple sheets into the sheet path from a single input tray by way of a torque limiter, 2) allows for reversal of the motor notwithstanding the torque limiter, 3) provides for positioning of lower sheets of media back on the stack in the input tray, and 4) allows for use of the motor to perform other operations while in a reverse mode without an inefficiently high torque load. However, it is contemplated that the devices disclosed herein may address other matters and deficiencies in a number of technical areas.

As used in the present specification and in the appended claims, the term "first direction" refers to a rotation of a component about a particular axis. For example, the first direction may be a counter-clockwise direction or a clockwise direction.

Accordingly, as used in the present specification and in the appended claims, the term "second direction" refers to a rotation of a component about a particular axis which direction is opposite the first direction. For example, when the first direction is counter-clockwise, the second direction is clockwise.

Further, as used in the present specification and in the appended claims, the term "a number of" or similar language is meant to be understood broadly as any positive number including 1 to infinity.

FIG. 1 is an isometric view of the sheet transport device (100) with a one-way clutch (102), according to an example of the principles described herein. As described above, the sheet transport device (100) can be included in any media-processing device such as a copier, printer, facsimile machine, scanner, multi-function machine, or combinations thereof.

The sheet transport device (100) includes various components to move sheets of media through the corresponding media-processing device. For example, the sheet transport device (100) includes a pickup roller (104) which is driven by a pickup shaft (106). The pickup roller (104) advances an uppermost sheet of media from an input tray into a sheet path. While a specific example of a paper media being advanced is described, any of various types of media, such as cardboard, plastic, or other substrate, can be implemented in accordance with the principles described herein. To engage the uppermost sheet of media, the pickup roller (104) may be formed of a material such as a soft plastic, rubber, or other high-friction material. Due to this friction, the uppermost sheet of media is advanced towards the pair of separations rollers (108, 110).

The pair of separation rollers (108, 110) include a first separation roller (108) and a second separation roller (110). The first separation roller (108) and second separation roller (110) are in contact with one another to form a nip (112) through which the sheet of media is conveyed from the pickup roller (104) to other parts along the sheet path. As with the pickup roller (104), the separation rollers (108, 110) are formed of a high friction material such as soft plastic or rubber to engage the uppermost sheet of media.

Each of the pickup roller (104), the first separation roller (108), and second separation roller (110) can be driven by a motor (114). More specifically, each component is coupled to the motor (114) via a set of gears, belts, and/or pulleys, which impart a rotational motion of the motor (114) into respective rotational motion of the pickup roller (104), the first separation roller (108), and the second separation roller (110). In the case of the first separation roller (108) and the second separation roller (110), this motion is transferred via the first separation shaft (116) and the second separation shaft (118) on which the first separation roller (108) and the second separation roller (110), respectively, are disposed.

To advance media, the first separation roller (108) and the second separation roller (110) rotate in opposite directions. For example, one rotates in a counter-clockwise direction and another in a clockwise direction as indicated in FIG. 1. However, in the present example, during operation, the motor (114) drives each of the pickup shaft (106), the first separation shaft (116), and the second separation shaft (118) in a same direction as indicated by the corresponding arrows. That is, in advancing the media, the second separation shaft (118) and the second separation roller (110) rotate in opposite directions. This occurs due to the operation of a torque limiter (120). Note the direction of rotation indicated in FIG. 1 may correspond to the advancement of a sheet media into the sheet path; however, the different components may be rotated differently to return sheet media to the input tray. Rotation of the rollers and shafts is described in more detail in FIGS. 2A-2C.

Returning to the torque limiter (120), a torque limiter (120) works by coupling two components together until a predetermined breakaway torque is reached. After this predetermined breakaway torque is reached, the torque limiter (120) disengages the two components such that each move independently of one another.

In the context of the present specification, the torque limiter (120) couples the second separation shaft (118) to the second separation roller (110) until the breakaway torque is reached. Once the breakaway torque is surpassed, the second separation roller (110) disengages from the second separation shaft (118). Upon disengagement, the second separation roller (110) is driven not by the second separation shaft (118), which is rotating in the same direction as the first separation shaft (116) and thereby impeding sheet transport, but is driven by the first separation roller (108) due to friction between the first separation roller (108) and the second separation roller (110). Being driven by the first separation roller (108), the second separation roller (110) is now rotating in a direction that facilitates sheet transport. Accordingly, the breakaway torque of the torque limiter (120) is chosen to be less than the frictional torque between the second separation roller (110) and the first separation roller (108) and/or the frictional torque between the media in the nip (112) and the second separation roller (110).

As described herein, during media advancement, both the first separation shaft (116) and the second separation shaft (118) rotate in the same direction, the first separation shaft (116) being directly coupled to the first separation roller (108). The counter-rotating aspect of the rollers (108, 110), i.e., that allows media to be passed through the nip (112), is facilitated by the torque limiter (120) which allows the second separation roller (110) to rotate opposite the second separation shaft (118) and thereby advance media through the nip (112) and into the sheet path.

Rotating the first separation shaft (116) and the second separation shaft (118) in the same direction facilitates preventing multi-sheet passage through the nip (112). Specifically, when there are two or more sheets of media between the nip (112), the frictional torque on the second separation roller (110) falls below the breakaway torque such that the torque limiter (120) couples the second separation roller (110) to the second separation shaft (118). In this example, i.e., when the first separation roller (108) is driven by the first separation shaft (116) and the second separation roller (110) is driven by the second separation shaft (118), the first separation roller (108) and the second separation roller (110) are rotating in the same direction, i.e., counterclockwise, or clockwise. As such, the first separation roller (108) advances the uppermost sheet into the sheet path and the second separation roller (110) returns the bottommost sheet back into the input tray.

The sheet transport device (100) also includes a one-way clutch (102) disposed on the second separation shaft (118) to disengage the second separation shaft (118) from the motor (114) when the motor (144) is operating in a reverse mode. The motor (114) may be operated in a reverse mode when returning a sheet of media to the input tray, for example at the conclusion of a print job. While in the reverse mode, the first separation shaft (116) is still engaged to the motor (114) so that it can move the sheet of media backwards into the output tray. In this example, the first separation shaft (116) is clutchlessly coupled to the motor (114). More specifically, the first separation shaft (116) may be directly coupled to the motor (114), and/or fixedly coupled to the motor (114) to be driven in a forward direction or mode, and a reverse direction or mode.

In some examples, the one-way clutch (102) may be a needle-bearing one-way clutch. However, other types of one-way clutches (102) may also be implemented in accordance with the principles described herein. In general, a one-way clutch (102) works by spinning freely on a shaft when rotated in one direction, but locks onto the shaft and does not spin when rotated in the other direction. By connecting the shaft drive gear to a one-way clutch, rather than directly to the shaft, the gear drives the shaft in one direction but disconnects the shaft when rotated in the other direction. In a needle-bearing one-way clutch, needles on the clutch spin freely in one direction, but jam into a wedge-shaped feature on the clutch housing when rotated in the opposite direction.

Figure 4:
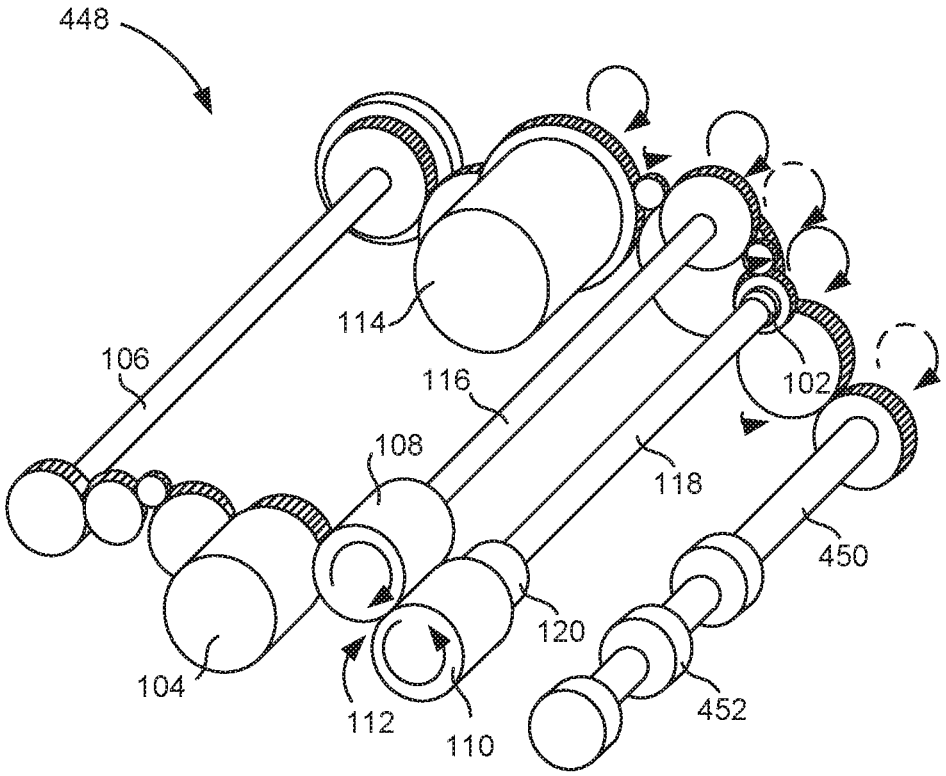
FIG. 4 is an isometric view of a sheet transport system with a one-way clutch, according to an example of the principles described herein.

Using a one-way clutch (102) to disengage 1) a torque limiter (120) and 2) an oppositely rotating second separation roller (110) from the motor (114) allows for a more efficient return of sheets of media to the input tray and also facilitates the driving of other components with the motor (114). More specifically, moving sheets of media through the sheet path, in either a forward direction or a reverse direction, imparts a high torque load on the motor (114). Accordingly, by disengaging the second separation shaft (118) when in a reverse direction, the torque load on the motor (114) is reduced which could allow a smaller motor (114) to be used and/or frees up motor (114) power to be used by other components. For example, as depicted in FIG. 4, another feed shaft may be engaged when the motor (114) is in the reverse mode and the second separation shaft (118) is disengaged. Moreover, disengaging at least part of the load in the reverse direction reduces the load on the motor (114) and can increase the life of the motor (114).

Figure 2A:
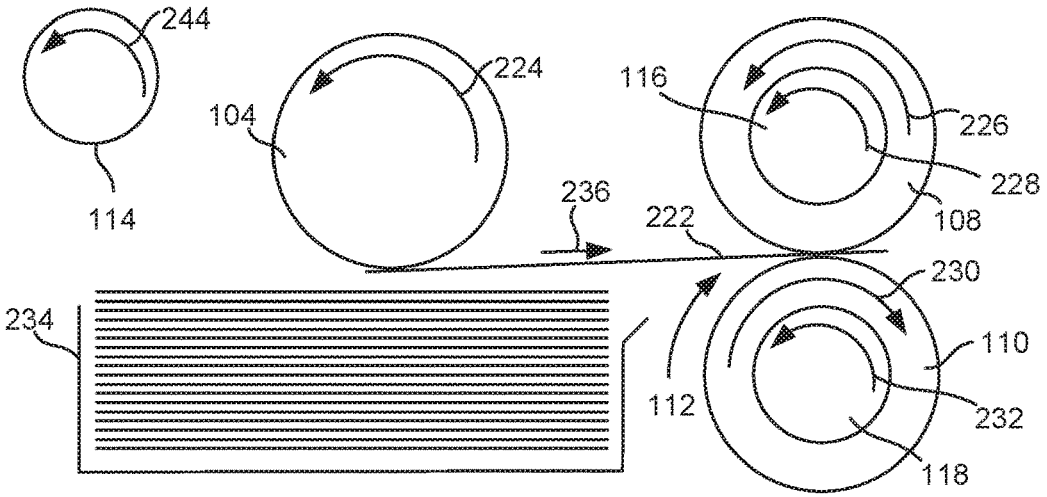
FIGS. 2A-2C are side views of the sheet transport device with a one-way clutch in various stages of operation, according to an example of the principles described herein.
Figure 2B:
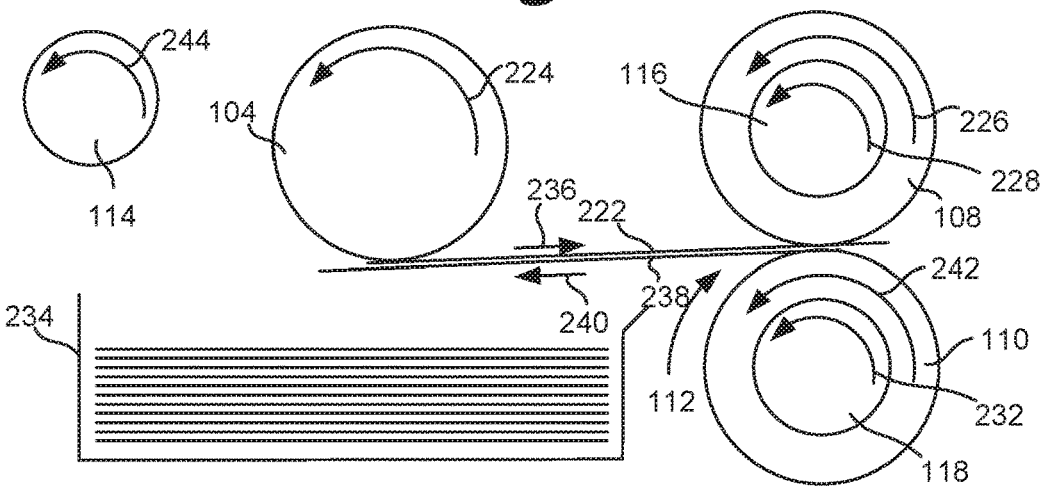
Figure 2C:
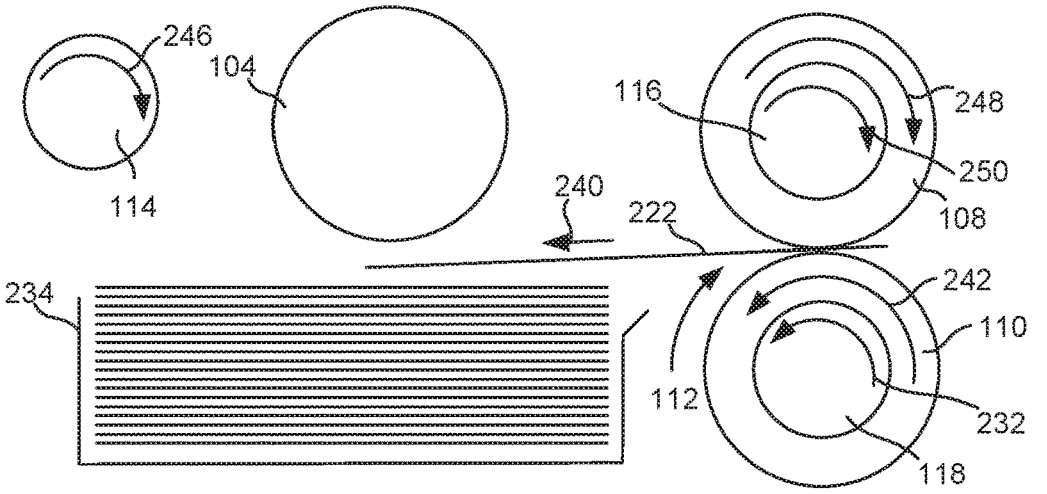

FIGS. 2A-2C are side views of the sheet transport device (FIG. 1, 100) with a one-way clutch (FIG. 1, 120) in various stages of operation, according to an example of the principles described herein. As described above, the sheet transport device (FIG. 1, 100) moves sheets of media from an input tray (234) along a sheet path where individual sheets of the media are processed. In one specific example of sheet processing, the sheet transport device (FIG. 1, 100) may be disposed in a printing device and may take the sheets of media from a main tray, or any other input tray, and pass the sheets by a fluid deposition device or toner deposition device that deposits fluid or toner onto the media to form an image and/or text. FIGS. 2A-2C depict the initial stages wherein media is inserted from the input tray (234) into the sheet path.

Specifically, in FIG. 2A, the motor (114), which is coupled to the pickup shaft (FIG. 1, 106), the first separation shaft (116) and the second separation shaft (118), rotates in a first direction as indicated by the arrow 244. The motor (114) rotates each shaft (FIG. 1, 106, 116, 118) in a first direction as indicated by the arrows 224, 228, and 232. As depicted in FIGS. 2A-2C, the first direction may be a counterclockwise direction, but in other examples, the first direction may be a clockwise direction.

The pickup roller (104) is disposed above the input tray (234) and can be activated to come into contact with the uppermost sheet (222) of the media in the input tray (234). Such activation can be facilitated by an arm that raises and lowers the pickup roller (104). As described above, the surface of the pickup roller (104) may be a high friction material such as a soft rubber, plastic or other high surface friction material, such that the friction between the pickup roller (104) and the topmost sheet (222) of media causes the topmost sheet (222) to be driven towards the nip (112), as indicated by the arrow 236.

When at the nip (112), the topmost sheet (222) of media is advanced through the nip (112) to other components of the media-processing device in which the sheet transport device (FIG. 1, 100) is disposed. This is due to the operation of the first separation roller (108) and the second separation roller (110). As depicted in FIGS. 2A-2C, the first separation shaft (116) may be on top of the advancing sheet (222) as the sheet (222) advances along the sheet path and the second separation shaft (118) may be on a bottom of the advancing sheet (222) as the sheet (222) advances along the sheet path.

The first separation shaft (116), which may be directly coupled to the motor (114), rotates in a first direction as indicated by the arrow 228. The first separation roller (108) which is clutchlessly, and directly, coupled to the first separation shaft (116) also rotates in the first direction as indicated by the arrow 226.

To advance the topmost sheet (222), the second separation roller (110) is rotated opposite the first separation roller (108). That is, given the depiction in FIGS. 2A-2C, the second separation roller (110) rotates in a clockwise direction as indicated by the arrow 230. This counter-rotation of the second separation shaft (118) and the second separation roller (110) is facilitated by the torque limiter (FIG. 1, 120). As described above, the torque limiter (FIG. 1, 120) operates to couple the second separation roller (110) to the second separation shaft (118) until a predefined breakaway torque is reached, after which the second separation roller (110) is disengaged from the second separation shaft (118) and rotates independently of the second separation shaft (118).

Under printing conditions, i.e., one sheet of media being fed through the printing device, the breakaway torque is surpassed such that the second separation roller (110) is driven by rotation of the first separation roller (108) and not the second separation shaft (118). That is, the torque limiter (FIG. 1, 120) is configured such that the second separation roller (110) is disengaged from the second separation shaft (118) due to the friction imparted by one sheet of media, but engages with the second separation shaft (118) when more than one sheet of media is present. Put another way, the friction imparted by one sheet of media in the nip (112) is greater than the breakaway torque, but the friction imparted by two sheets of media in the nip (112) is not greater than the breakaway torque. Put yet another way, a torque is applied to the second separation roller (110) by way of the second separation shaft (118) to oppose paper movement, but this torque is overcome by friction between the first separation roller (108) and the second separation roller (110) or the sheet (222) of media and the second separation roller (110). As with the pickup roller (104), the separation rollers (108, 110) are formed of a soft plastic, rubber, or other such material to frictionally engage the sheets of media as they pass through the nip (112).

When a second sheet (238) of media is fed into the nip (112), these same components operate to prevent the second sheet (238) from being inserted into the sheet path until the first sheet (222) has passed the nip (112). Specifically, as depicted in FIG. 2B, the second sheet (238) of media in the nip (112) reduces the friction such that the torque felt by the second separation roller (110) is less than the breakaway torque for the torque limiter (120). Consequently, the second separation roller (110) is re-engaged with the second separation shaft (118) which is rotating in the first direction as indicated by the arrow 232. Being coupled to the second separation shaft (118), the second separation roller (110) also rotates in the first direction as indicated by the arrow 242. Accordingly, the first separation roller (108) works to advance the topmost sheet (222) of media along the sheet path as indicated by the arrow 236 and the second separation roller (110) works to return the second sheet (238) of media back to the input tray (234) as indicated by the arrow 240. In other words, responsive to the presence of more than one sheet of media in the nip (112), the second separation roller (110) rotates in the first direction as a first sheet (222) is advanced along the sheet path.

By operating in this fashion, the sheet transport device (FIG. 1, 100) prevents feeding multiple sheets of media into the media-processing device by stopping the second sheet (238) from further advancing and returning it to the input tray (234). Such operation ensures print quality, increases control over the media processing, and prevents jamming of the media within the media processing system as a whole.

FIG. 2C depicts the operation of the motor (114) in a reverse direction as indicated by the arrow 246. When rotating in the second direction, the motor (114) is disengaged from the pickup roller (104) such that the pickup roller (104) is not interacting with any media. In this example, the pickup roller (104) may be raised so as to not contact any sheet in the input tray.

As it is directly coupled to the motor (114), the first separation shaft (116) also rotates in the second direction as indicated by the arrow 250. The first separation roller (108) being directly coupled to the first separation shaft (116) thereby also rotates in the second direction as indicated by the arrow 248.

As described above, the second separation shaft (118) is indirectly coupled to the motor (114) via a one-way clutch (FIG. 1, 102). When the motor (114) is operating in the first direction, i.e., as indicated by the arrow 244, the second separation shaft (118) is rotated via the motor (114). However, when the motor (114) is rotating in the second direction, as indicated by the arrow 246, the one-way clutch (FIG. 1, 102) disengages the second separation shaft (118), which has the torque limiter (FIG. 1, 120), from the motor (114) and as such the second separation roller (110) and second separation shaft (118) are rotated in second direction as indicated by arrows 242 and 232. This rotation is due to the friction force between the first separation roller (108) and the second separation roller (110). Accordingly, any topmost sheet (222) of media, or any media, that is in contact with the nip (112) is propelled backwards as indicated by the arrow 240 into the input tray (234).

In summary, as depicted in FIGS. 2A-2C, when operating in a first mode, i.e. when rotating in a first direction (244), the motor (114) drives the pickup roller (104) and the first separation roller (108) in the first direction (224, 226). In this first mode, the second separation roller (110) rotates in the second direction (230). Note that when the second separation roller (110) rotates in the second direction (232) in FIG. 2B, the second separation roller (110) it is driven directly by the motor (114).

By comparison, when operating in a reverse mode, i.e., when rotating in a second direction (246), the motor (114) drives the first separation roller (108) in the second direction (248) and is disengaged form the second separation roller (110) and the pickup roller (104). Note that when the second separation roller (110) rotates in the second direction (242) in FIG. 2C, the second separation roller (110) it is not driven directly by the motor (114), but is driven by the friction force with the first separation roller (108).

Such a reversal may be desirable at the end of a print job and may prevent paper jams and marring of the paper surface. For example, some input trays (234) are removable so as to allow the loading of media. A media sheet that is partially in the input tray (234) and thereby partially in the nip (112) may be marred when the input tray (234) is removed. The system described herein prevents such partial placement of media in the input tray (234) thus preventing such marring and other complications.

Figure 3:
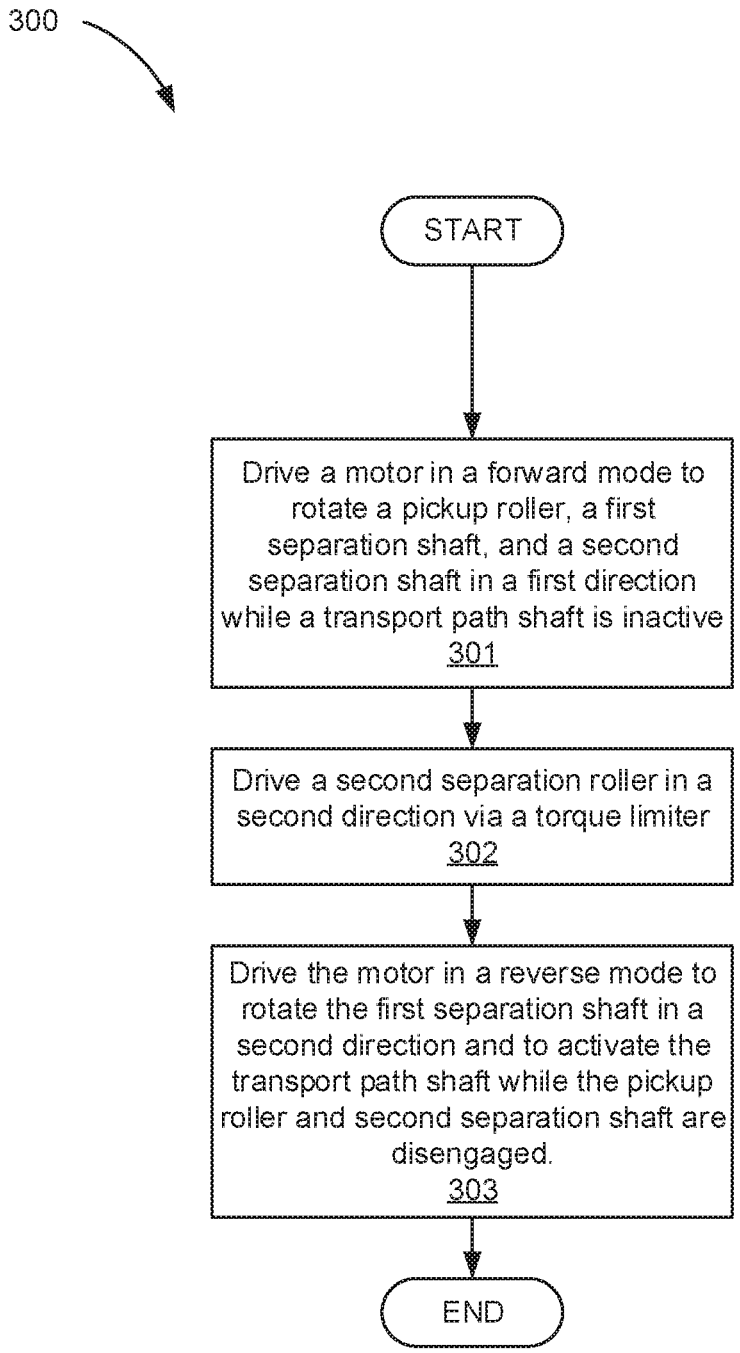
FIG. 3 is a flowchart of a method for transporting sheets of media, according to an example of the principles described herein.

FIG. 3 is a flowchart of a method (300) for transporting sheets of media, according to an example of the principles described herein. According to the method (300), a motor (FIG. 1, 114) is driven (block 301) in a forward mode. In the forward mode, the motor (FIG. 1, 114) rotates the pickup roller (FIG. 1, 104), the first separation shaft (FIG. 1, 116), and the second separation shaft (FIG. 1, 118) in a first direction. Still further, while in the forward mode, a transport path shaft, which directs media from another tray along the sheet path, is inactive, meaning it does not form part of the sheet path. In this example, the transport path shaft may be disengaged for example, via a one-way clutch, or may simply not be in contact with media, as this shaft does not form part of the media path from the input tray into the printing device. At the same time, the second separation roller (FIG. 1, 110) which is disposed on the second separation shaft (FIG. 1, 118) is driven (block 302) in a second direction, opposite the first direction, by operation of a torque limiter (FIG. 1, 120). Note that in this example, the second separation shaft (FIG. 1, 118) is rotated in a first direction by operation of the motor (FIG. 1, 114) and the second separation roller (FIG. 1, 110) is rotated in a second direction due to the friction force with the first separation roller (FIG. 1, 108) rotating in the first direction.

With the first separation roller (FIG. 1, 108) and the second separation roller (FIG. 1, 110) rotating in opposite directions, media arriving at the nip (FIG. 1, 112) is advanced into the sheet path to other components of the processing system, for example to a fluid/toner ejection device to receive print fluid/toner.

The motor (FIG. 1, 114) can also be driven (block 303) in a reverse mode. In so doing, media can be replaced into the input tray (FIG. 2, 234). Specifically, when driven (block 303) in the reverse mode, the first separation shaft (FIG. 1, 116) rotation is reversed to the second direction. Moreover, when operated in the reverse mode, the transport path shaft is activated and the pickup roller (FIG. 1, 104) and the second separation shaft (FIG. 1, 118) are disengaged from the motor (FIG. 1, 114). That is, the one-way clutch (FIG. 1, 102) of the second separation shaft (FIG. 1, 118) decouples the second separation shaft (FIG. 1, 118) from the motor (FIG. 1, 114) so as to reduce the torque load on the motor (FIG. 1, 114).

In this configuration, the second separation shaft (FIG. 1, 118) still rotates, but not due to the effect of the motor (FIG. 1, 114) directly, but rather due to its coupling with the second separation roller (FIG. 1, 118) which is rotated due to friction between the first separation roller (FIG. 1, 108) and the second separation roller (FIG. 1, 110). Activation of the transport path shaft can include driving the transport path in a particular direction as the motor (FIG. 1, 114) is operated in the reverse mode.

Driving (block 303) the motor (FIG. 1, 114) in the reverse mode can be done for any number of reasons. For example, at the termination of a particular print job, it may be desirable to ensure that no sheets of media are partially disposed in the input tray (FIG. 2, 234). Accordingly, the motor (FIG. 1, 114) may be driven in the reverse mode responsive to a termination of a print job. In other examples, the motor (FIG. 1, 114) is driven in the reverse mode after being idle for a predetermined period of time. Disengaging the second separation shaft (FIG. 1, 118) from the motor (FIG. 1, 114) may be done with just an electrical signal to reverse the motor (FIG. 1, 114). In other words, there is no additional electrical stimulus, other than electrical stimulus to operate the motor (FIG. 1, 114), used to disengage the second separation shaft (FIG. 1, 118) from the motor (FIG. 1, 114).

Operating the sheet transport device (FIG. 1, 100) in this fashion provides for efficiently moving media into the sheet path, preventing feeding multiple pages simultaneously into the sheet path from a single input tray (FIG. 2, 234), and also allows for returning media to an input tray (FIG. 2, 234) following the termination of a print job originating from the input tray (FIG. 2, 234). Moreover, while in the reverse mode, other components of the parent system can be activated such as a transport path shaft that directs sheets of media originating from another location within the parent system along the sheet path, an example of which is provided below in connection with FIG. 4. Disengaging the second separation shaft (FIG. 1, 116) while in the reverse mode reduces the torque on the motor (FIG. 1, 114) which 1) lengthens the motor (FIG. 1, 114) life, and 2) allows different apparatus to draw from the power of the motor (FIG. 1, 114).

FIG. 4 is an isometric view of a sheet transport system (448) with a one-way clutch (102), according to an example of the principles described herein. The sheet transport system (448) includes the sheet transport device (FIG. 1, 100) described above, which includes a pickup roller (104) to insert a sheet from a sheet tray into a sheet path. The pickup roller (104) is driven by a pickup shaft (106), however as depicted in FIG. 4, the motor (114) is operated in a reverse mode such that the pickup roller (104) is disengaged from the motor (114). The sheet transport device (FIG. 1, 100) also includes the pair of separation rollers (108, 110) and the corresponding separation shafts (116, 118). Specifically, the second separation shaft (118) includes the one-way clutch (102) and the torque limiter (120). The sheet transport device (FIG. 1, 100) also includes the motor (114) which drives the various shafts.

In addition to the sheet transport device (FIG. 1, 100), the sheet transport system (448) also includes a transport path roller (452) to advance a media sheet not originating from the input tray (FIG. 2, 234). The motor (114) is coupled to the transport path shaft (450) such that the transport path shaft (450) is inactive as the motor (114) rotates in a first direction, but is engaged and rotates, as the motor (114) rotates in the second direction as depicted in FIG. 4. In other words, the motor (114), rotated in a forward direction drives the pickup shaft (106), the first separation shaft (116), and the second separation shaft (118). When in a reverse direction as depicted in FIG. 4, the motor (114) drives the first separation shaft (116) and the transport path shaft (450). When in the forward mode, the motor (114) may be disengaged from the transport path shaft (450) and when operating in the reverse mode, the motor (114) drives the transport path shaft (45) to advance a second sheet along the sheet path. This second sheet may not originate from the input tray (FIG. 2, 234) but may originate from another paper tray, such as a lower paper tray.

Note that the directions indicated in FIG. 4 correspond to driving the motor (114) in the reverse mode. That is the pickup roller (106) is disengaged from the system. Note also that the directions in dashed lines correspond to the driving system of the transport path shaft (450). Still further, the rotation of the second separation roller (110) is not from the motor (114) through the second separation shaft (118), but is rather through the frictional force with the first separation roller (108).

In one example, using such a sheet transport system 1) allows for prevention of the insertion of multiple sheets into the sheet path via a torque limiter, 2) allows for reversal of the motor notwithstanding the torque limiter, 3) provides for positioning of lower sheets of media back on the stack in the input tray, and 4) allows for use of the motor to perform other operations while in a reverse mode without an inefficiently high torque load. However, it is contemplated that the devices disclosed herein may address other matters and deficiencies in a number of technical areas.

The preceding description has been presented to illustrate and describe examples of the principles described. This description is not intended to be exhaustive or to limit these principles to any precise form disclosed. Many modifications and variations are possible in light of the above teaching.

What is claimed is:

1. A method, comprising:

driving a motor in a forward mode to rotate a pickup roller, a first separation shaft, and a second separation shaft in a first direction while a transport path shaft is inactive;

driving a second separation roller disposed on the second separation shaft in a second direction via a torque limiter; and driving the motor in a reverse mode to rotate the first separation shaft in the second direction and to, via a clutch, activate the transport path shaft while the pickup roller and second separation shaft are disengaged.

2. The method of claim 1, wherein the motor is driven in the reverse mode responsive to a termination of a print job.

3. The method of claim 1, wherein the motor is driven in the reverse mode after being idle for a predetermined period of time.

4. The method of claim 1, wherein driving the second separation roller in the second direction comprises disengaging the torque limiter with just an electrical stimulus to reverse the motor.

5. The method of claim 1, further comprising driving a transport path shaft by driving the motor in the reverse mode.

6. The method of claim 1, wherein while driving the motor in the reverse mode, the second separation roller is driven by a friction force with the first separation roller.

7. The method of claim 1, wherein while driving the motor in a reverse mode:

raising the pickup arm so as to not contact sheets in an input tray; and disengaging the second separation shaft from the motor via a one-way clutch.

8. A method, comprising:

when no sheets of media are between a first separation roller and a second separation roller, driving a motor in a forward mode such that a pickup roller, first separation shaft, the first separation roller, second separation shaft, and the second separation roller are rotating in a first direction;

when one sheet of media is between the first separation roller and a second separation roller, disengaging the second separation roller from the second separation shaft such that:

the pickup roller, first separation shaft, first separation roller, and second separation shaft are rotating in the first direction; and the second separation roller is rotating in a second direction due to interaction with the first separation roller; and when multiple sheets of media are between the first separation roller and the second separation roller, reengaging the second separation roller to the second separation shaft such that the pickup roller, first separation shaft, first separation roller, second separation shaft, and second separation roller are rotating in the first direction.

9. The method of claim 8, further comprising setting a breakaway torque coupled to the second separation roller such that:

the second separation roller disengages from the second separation shaft due to friction imparted by one sheet of media in a nip with the first separation roller; and the second separation roller engages with the second separation shaft due to friction imparted by two sheets of media in the nip.

10. The method of claim 8, wherein when multiple sheets of media are between the first separation roller and the second separation roller:

The first separation roller advances an uppermost sheet into a sheet path; and the second separation roller returns a bottommost sheet back into an input tray.

11. The method of claim 8, further comprising, when operating a motor in a reverse mode, disengaging the second separation shaft from the motor.

12. The method of claim 8, further comprising:

setting a breakaway torque for a sheet transport device comprising the pickup roller and separation rollers, setting the breakaway torque such that one sheet of media disposed in a nip formed by the first separation roller and the second separation roller disengages the second separation roller from the second separation shaft that is driven by the motor;

moving a sheet of media into the nip via the pickup roller driven by the motor; and when a second sheet of media enters the nip, engaging the second separation roller to the second separation shaft to return the second sheet of media to the input tray as a friction imparted by two sheets of media at the nip is less than the breakaway torque.

13. The method of claim 12, further comprising at a termination of a print job, returning sheets of media to the input tray by disengaging the second separation shaft from the motor.

14. The method of claim 12, further comprising driving a transport path shaft to transport a sheet of media not in the input tray by driving the motor in a reverse mode.

* * * * *